US005779497A

United States Patent [19]

Hale et al.

[11] Patent Number: 5,779,497

[45] Date of Patent: Jul. 14, 1998

[54] QUICK WIRE ELECTRICAL SOCKET

[75] Inventors: Scot J. Hale, Williston Park; James N. Pearse, Dix Hills; Dennis A. Oddsen, Eatons Neck; Anthony C. Tufano, North Massapequa, all of N.Y.

[73] Assignee: Leviton Manufacturing Co., Inc., Little Neck, N.Y.

[21] Appl. No.: 738,740

[22] Filed: Oct. 28, 1996

[51] Int. Cl.[6] ..... H01R 4/24

[52] U.S. Cl. ..... 439/419

[58] Field of Search ..... 439/409, 410, 439/418, 419, 456, 459, 596

[56] References Cited

U.S. PATENT DOCUMENTS 4,759,723 7/1988 Siemon ..... 439/459
4,874,329 10/1989 Yu ..... 439/409
5,552,348 9/1996 Wu ..... 439/419

*Primary Examiner*—Gary F. Paumen
*Assistant Examiner*—Yong Ki Kim
*Attorney, Agent, or Firm*—Paul J. Sutton

[57] ABSTRACT

A lamp socket assembly having insulation piercing and displacing contacts which make electrical and mechanical joints with the two conductors of an electrical lamp cord. The contacts have two pointed ends to pierce the insulation and a slot between to sever and displace the insulation from the contact which is arranged transverse to the path of the cord in the socket. An actuating lever, pivotally mounted to the socket body, is held in different ratchet controlled position ranges to hold the lever and socket in assembly and accept the cord end and then force the cord in to the insulation piercing and displacing contacts. A strain relief member is made to engage the cord when the lever is fully operated.

16 Claims, 8 Drawing Sheets

QUICK WIRE ELECTRICAL SOCKET

BACKGROUND OF THE INVENTION

1. Field of the Invention

The invention pertains to electrical sockets for use with light bulbs and more particularly to sockets which do not require the use of terminal screws with the bared ends of conductors but use insulation displacing contacts to sever the insulation and displace same to allow electrical contact with the bare metal of the conductors within.

2. Description of the Prior Art

Lamp cord or so called "Zip" cord having two side by side conductors each individually insulated and joined to one another by a web is commonly used for wiring electrical devices, for extension cords and similar devices. One way of using such cord is to strip the insulation from the ends of the conductors and join the conductors to such devices at terminal screws. Another method uses quick wiring techniques on such devices as lamp sockets, switches, taps and receptacles, in which the fully insulated lamp cord is inserted into the device adjacent one or more insulation piercing contacts for each conductor and an actuating device is operated to cause the contacts to pierce the insulation and make electrical contact with the conductors within.

A typical device of this latter arrangement is shown in U.S. Pat. No. 4,874,329 issued Oct. 17, 1989. FIG. 1 of the instant Application is FIG. 3 of the '329 patent. Two sets of saw-tooth shaped insulation piercing contacts 151 and 161 are shown. The electrical cord 17 is inserted into chamber 143' through an opening 144. The actuating device or coupling means 14 is then pushed towards the serrated piercing terminal portions 151 and 161. The width of the piercing terminal portions 151 and 161 are transverse to the strands of wires in the cord 17. These portions 151 and 161 generally sever the wire strands they engage decreasing the number of strands available to conduct current, increasing the current density in the remaining strands and causing the joint to run hotter than it normally would and perhaps cause the joint to burn up. The unsevered strands of wire are held in place against the piercing terminal portions by the insulation above the terminal portions. However, as the insulation ages, hastened by the heat from the joint, the insulation thins, shrinks, hardens, evaporates and creeps permitting the wire strands to move away from the terminal portion further increasing the possibility of joint failure with attendant overheating, smoking, burning and perhaps, fire.

With some of the newer cord insulations using synthetic rubber or plastics or the like there is chance that wide chisel-like terminal portions will merely distort the insulation but not pierce it or drag a portion of the insulation with the terminal portion into the cord making for a poor or no electrical joint with the conductors.

Because of the placement of the serrated piercing terminal portions 151, 161 in the '329 abreast of one another and at the end opposite to the fulcrum of coupling means 14 a great deal of force is required to pierce the cord insulation and because of the lack of lateral support the terminal portions 151, 161 may be deflected sideways entering the insulation but not the wire strands.

SUMMARY OF THE INVENTION

The instant invention overcomes the difficulties noted above with respect to the prior art. The novel socket employs insulation piercing and displacing contacts that are arranged transverse to the path of the insulated cords and which include a pointed end to pierce the cord insulation and a slot which severs and displaces the insulation so that the walls of the slot make good electrical contact with the wire strands of the electrical cord. The novel contacts are staggered and closer to the fulcrum of the actuating device and this, coupled with the contact's insulation piercing points, requires far less installation force. The slot gathers the strands together into a bundle within the slot and causes the strands to bulge before and after the contact to improve the contact's grip on the strands of the conductor. Thus the strands of wire and the contacts make the joint exclusive of the cord insulation. Since the walls of the slot engage unsevered strands of wire a better electrical joint is formed which is not subject to a high resistance contact, heating, burning of the insulation and contact and failure.

The actuating device is pivotally coupled to the insulating housing of the socket and moves into and out of a U-shaped recess across a free end face of the housing. The actuating device further has one or more indexing fingers on its outer surface which can be made to engage one of a number of ratchet steps on the adjacent walls of the recess to selectively position and hold the actuating device at such selected positions with respect to the recess and the housing and prevent retrogression of the actuating device beyond certain preset ratchet steps. By including an upstanding member on the housing in the recess and removing part of the floor of the actuating device, a strain relief grip is established between the end of the upstanding member and inside surface of the actuating device top wall. It is an object of this invention to provide a socket which can be applied to an electrical cord without having to remove the insulation from the cord and apply the bared ends to screw terminals.

It is another object of this invention to provide a socket using insulation piercing and displacing contacts and where the lamp cord to be connected to the contacts is guided into engagement by an actuating device.

It is yet another object of this invention to provide a quick wiring socket having insulation piercing and displacing contacts placed transverse to the position of the electrical cord in such socket and having a slot to receive and engage the wire strands of the cord and points at the ends of the walls defining the slots to pierce the cord insulation.

It is another object of this invention to provide a quick wiring socket using insulation piercing and displacing contacts positioned transverse to the electrical cord in the socket, staggered and closer to the actuating device pivot to permit installation at low applied force levels.

It is still another object of the invention to provide a novel socket employing an actuator device to cause engagement between the lamp cord and contacts which can be selectively positioned and maintained at various positions with respect to the socket insulating body.

It is yet another object of the invention to provide strain-relief for lamp cord connected to the contacts of the socket of this invention.

It is another object of the invention to provide a socket which provides strain relief for the electrical cord used to wire the socket.

It is an object of the invention to provide a socket having an insulating housing with a recess in one end face thereof, an actuating device pivotally mounted to said housing for movement into and out of said recess, said housing having indexing tabs to engage ratchet steps on the housing to fix the position of the actuating device and prevent retrogression beyond certain limits, a strain relief member to engage the cord entering the socket and insulation displacing contacts to engage the central metal conductors.

Other objects and features of the invention will be pointed out in the following description and claims and illustrated in the accompanying drawings, which disclose, by way of example, the principles of the invention, and the best mode which is presently contemplated for carrying them out.

BRIEF DESCRIPTION OF THE DRAWINGS

In the drawings in which similar elements are given similar reference characters.

DESCRIPTION OF THE PREFERRED EMBODIMENT

Figure 1:
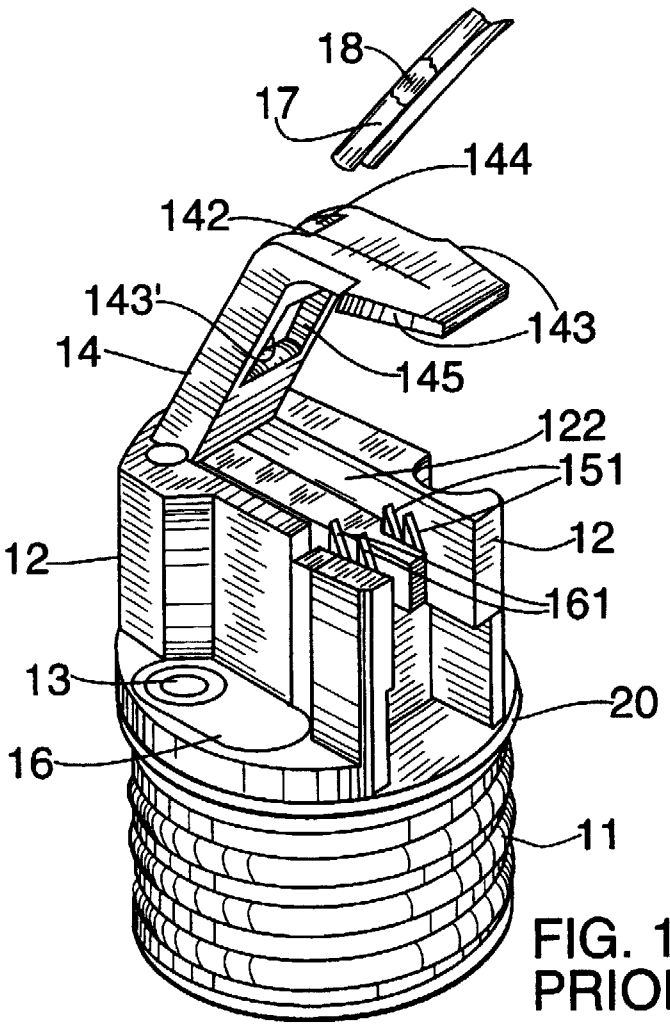
FIG. 1 PRIOR ART
FIG. 1 is a top left perspective view of a socket according to the prior art and is FIG. 3 of U.S. Pat. No. 4,874,329 issued Oct. 17, 1989.
Figure 3:
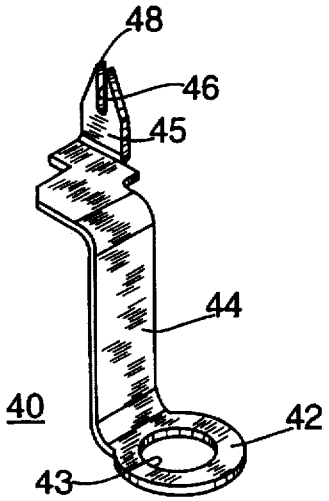
FIG. 3 is a top left perspective view of one of the insulation displacing electrical contacts of the instant invention.

Turning now to FIG. 1 a socket assembly according to U.S. Pat. Ser. No. 4,874,329 issued Oct. 17, 1989 is shown. A non-conductive body 12 is connected to screwshell 11 with insulating plate 20 positioned between them. A rivet 13 connects the negative conducting piece 16, body 12, plate 20 and screwshell 11. Negative conducting piece 16 ends in serrated piercing terminal portion 161 in recess 122 of body 12. Conducting piece 16 is thus connected to screwshell 11 and will engage the threaded metal screw base of an inserted bulb or lamp (not shown).

The positive conducting piece 15 (not shown) ends in serrated piercing terminal portion 151 also in recess 122 of body 12. Conducting piece 15 is coupled to a positive member 30 (not shown) which engages the contact button of an inserted bulb or lamp (not shown).

Actuating device or coupling means 14 is generally rectangular with an opening 144 at the junction between the horizontal and vertical legs of coupling means 14. An aperture 145 in coupling means 14 permits communication within chamber 143' of piercing terminal portions 151, 161 with the conductors 18 of the electrical cord 17 inserted into coupling means 14 via opening 144. As is evident from FIG. 1, piercing terminal portion 151 has two saw-tooth shaped members each with its piercing edge transverse to the conductor 18 adjacent them. When the coupling means 14 is pushed toward recess 122 the terminal portions 151 extend through aperture 145 into chamber 143' and one of the conductors 18. Because of the distance between the pivot of coupling means 14 and the terminal portions 151, the resilience of the coupling member 14 and the wide top edge of the terminal portions 151, a great deal of force must be applied to coupling member 14 to permit the terminal portions 151 to pierce the insulation of the electrical cord 17 and the conductors 18. If the insulation is of synthetic rubber, plastics or other flexible, resilient materials the insulation may only be distorted or a portion may be dragged into the electrical conductors 18 making no contact or a poor, high resistance contact at best.

In the event that the terminal portions do pierce the conductor 18 insulation, then the edges of the terminal portions 151 will sever most of the strands of the conductor 18 it engages. Since the remaining strands must carry the current, the current density will increase with its attendant problems of conductor or insulation failure. The conductor 18 could run so hot it burns up or the heating could cause the insulation to overheat, dry out, crack and fall off of the conductor, could cause the insulation to track, thin, creep, shrink, loose resilience, smoke, burn or cause a fire. The only junction between the terminal portions 151 and the conductor 1 would be to those strands which engage the sides of the terminal portions 151 and which are not broken.

Also, because the resilience of the insulation between the conductor 18 and the top wall of chamber 143' is the force that maintains any contact between the strands of the conductor 18 and the terminal portions 151 any reduction of the insulation thickness or resilience from the above stated causes or due to simple aging of the insulation, will decrease the force holding the conductor 18 in contact with terminal portions 151 and interfere with the functioning of the joint. The above described events will also occur between terminal portions 161 and the conductor 18 adjacent terminal portions 161.

Figure 4:
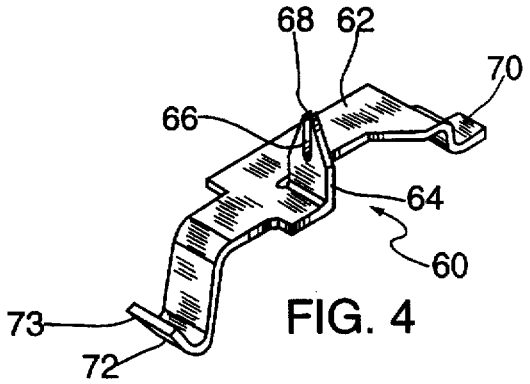
FIG. 4 is a top, right perspective view of the second of the insulation piercing and displacing electrical contacts of the instant invention.
Figure 5:
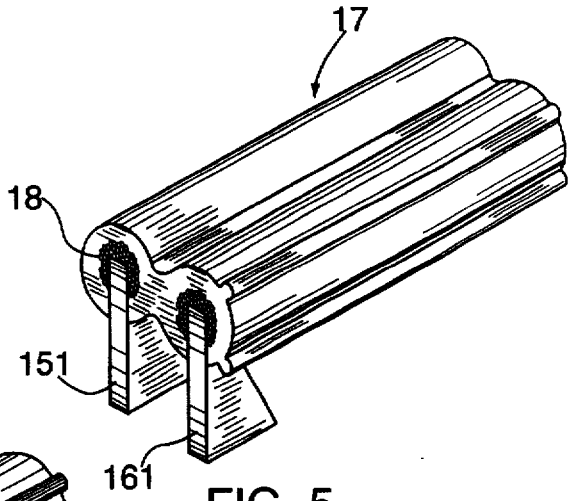
FIG. 5 is a top right perspective view of an electrical cord installed upon two insulation piercing contacts according to the prior art.
Figure 7:
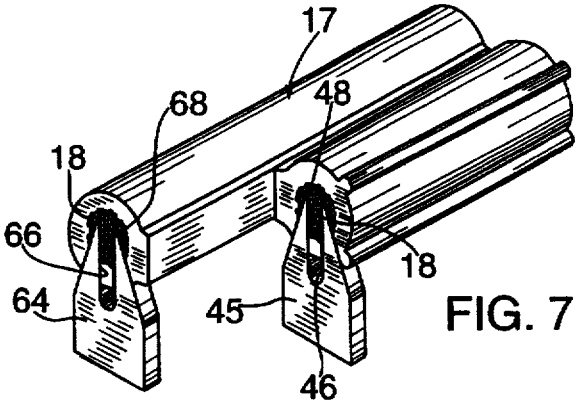
FIG. 7 is a top right perspective view of an electrical cord installed upon two insulation piercing and displacing contacts according to the instant invention.
Figure 8:
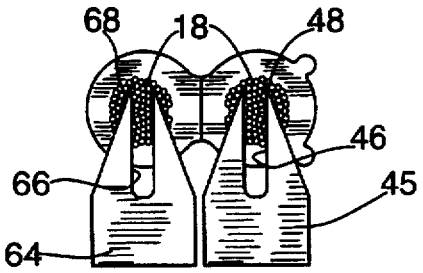
FIG. 8 is a front elevational view of the electrical cord and contacts of FIG. 7.
Figure 6:
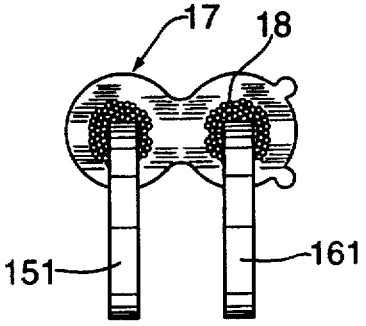
FIG. 6 is a front elevational view of the electrical cord and contacts of FIG. 5
Figure 9:
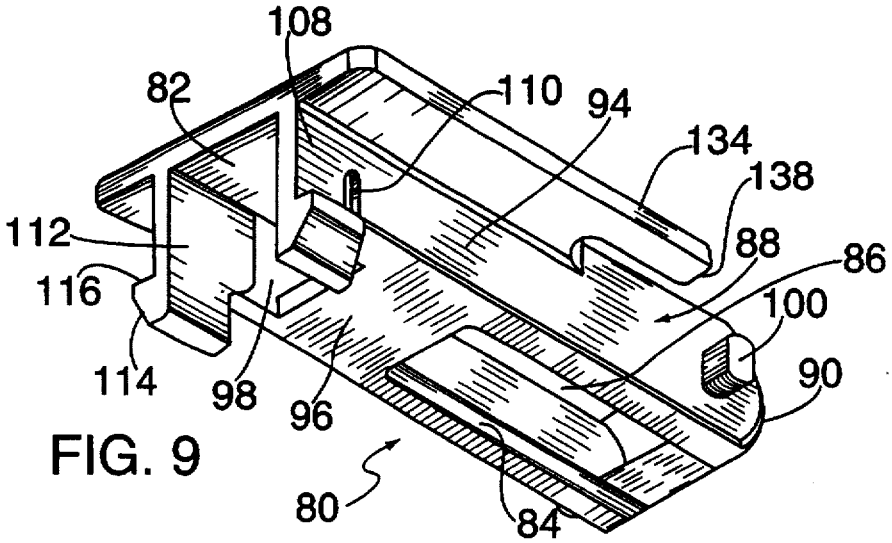
FIG. 9 is a bottom right perspective view of the actuating device of FIG. 2.
Figure 10:
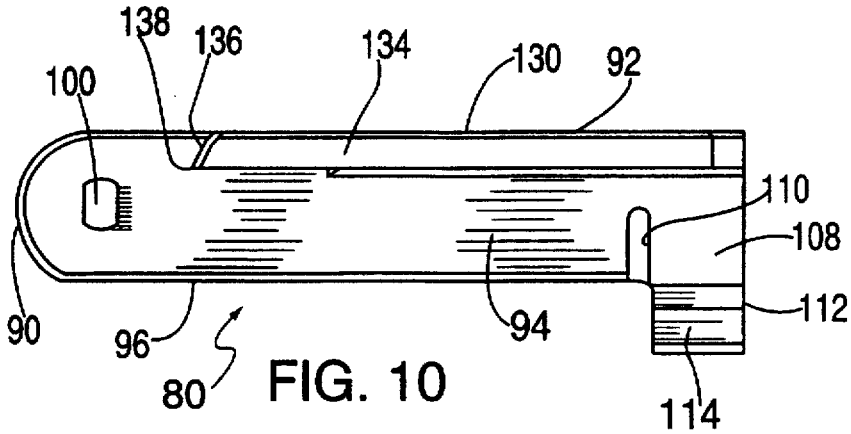
FIG. 10 is a side elevational view of the actuating device of FIG. 9.
Figure 20:
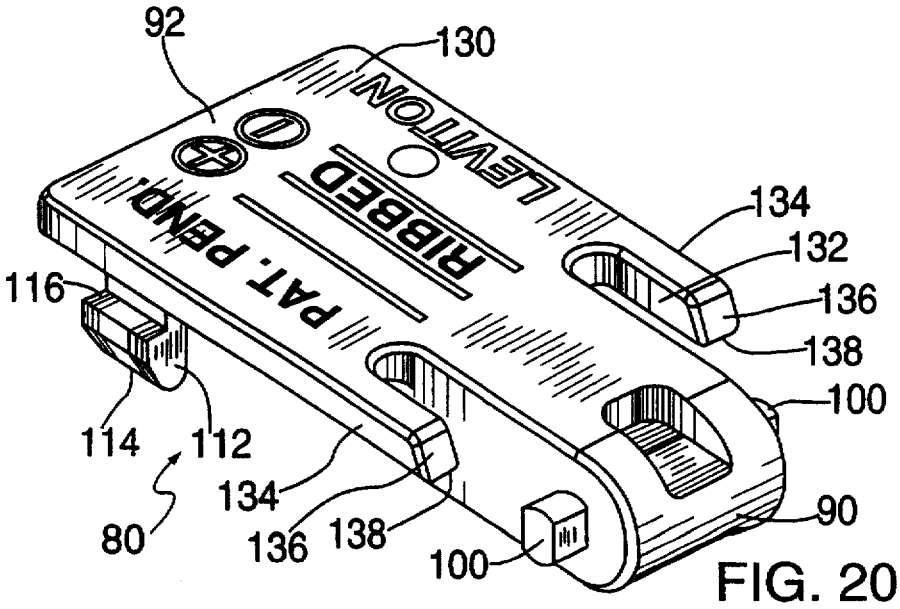
FIG. 20 is a top left perspective view of the actuating device of FIG. 9.

FIGS. 4 and 5 illustrate the interaction of the terminal portions 151, 161 with the wire strands of conductors 18 in electrical and 17. Assuming a generally circular shape of the wire strands of conductors 18, most of the wire strands that would occupy the central portion of the conductors 18 but now occupied by the terminal portions 151 and 161 are severed and not able to conduct current. Some of wire strands of conductors 18 will be outwardly displaced and these and the other conductors already at the sides and top of terminal portions 151 and 161 and which contact the sides and top of terminal portions 151 and 161 will conduct current between terminal portions 151 and 161 and conductors 18 of electrical cord 17. As is clearly evident from these figures a large number of wire strands have been severed and are of no further use to carry current.

Referring now to FIGS. 2, 3, 4, 7, 8 and 21 a quick wired electrical socket 10 according to the instant invention is shown. A non-conductive body 220 is formed of thermoset or thermoplastic plastic materials, phenolic or other insulating materials. Placed between screwshell 211 and lower end 224 of body 220 is an insulating plate 222, all three held together by rivet 13 which passes through an aperture 43 in the mounting tab 42 of first insulation piercing and displacing contact 40 holding it in place and makes electrical contact between contact 40 and the screwshell 211. As stated above, screwshell 211 makes contact with the screw threads of the base of an inserted bulb or lamp (not shown). Body 220 has a recess 28 which extends inwardly from upper end 26 of body 220 and extends across the entire width of body 220. Contact 40 has a body portion 44 from which tongue 45 is formed and in which is placed an insulation severing and displacing slot 46 and the free ends or tips of tongue 45 adjacent the slot 46 are pointed as at 48. A portion of tongue 45, slot 46 and the pointed free ends 48 extend into the recess 28.

A second insulation piercing and displacing contact 60 which is connected to a further member (not shown) and in turn to the flexible contact within the screwshell 211 (not shown) which engages the button contact of a bulb or lamp (not shown) placed in screwshell 211. Contact 60 has a body portion 62 from which a tongue 64 is struck and bent upwardly perpendicular to the plane of the remainder of body portion 62. Tongue 64 contains an insulation severing and displacing slot 66 and the free ends or tips of tongue 64 adjacent the slot 66 are pointed as at 68. Ends 70 and 72 will be positioned in suitable slots in body 220 and end 70 will be coupled to the further member and flexible contact in screwshell 211 and not shown.

A twin-parallel conductor electrical cord 17 (not shown) is inserted through entrance 82 into chamber 86 of the actuating lever 80 and the actuating lever 80 is rotated about its pivots towards the body 220. This permits the pointed ends 68 of tongue 64 of contact 60 to enter the insulation of a first conductor 18 followed by the entry of the pointed ends 48 of tongue 45 of contact 40 into the insulation of the second conductor 18. The staggering of the positions of tongues 64 and 45 decreases the amount of force that must be applied to actuating lever 80 to obtain contact with the conductors 18 as compared with in line contacts such as terminal portions 151 and 161 of the '329 patent. Also, the placement of the tongues 64 and 45 closer to the pivots of actuating lever 80 allows greater force to be applied to the conductors 18 at the tongues 64 and 45 for the same externally applied force as compared to the '329 which spaces terminal portions 151 and 161 remote from the pivot of coupling means 14. The placement of the tongues 64 and 45 closer to the pivot of actuating lever 80 also prevents loss of applied force due to the bending or distortion of the actuating lever 80 along its length. Finally, the pointed ends 68, 48 of tongues 64 and 45, respectively, pierce the insulation of the conductors 18 and move the insulation away from the slots 46, 66, respectively, also decreasing the amount of applied force required.

As the tips 68, 48 of tongues 64, 45, respectively, advance in the insulation about the conductors 18 the shape edges of the slots 66, 46 slice through the insulation and separate it along the thickness of tongues 64 and 45 permitting excellent electrical contact between tongues 64 and 45 and the wire strands of the conductors 18. As the force of the tongues 64, 45 moves further into the conductors 18, the wire strands tend to move into the open slots 66 and 46, respectively, in that the open slots present little resistance to the movement of the wire strands which results in the axial alignment of the wire strands and the concentration and confinement of the wire strands in the slots 66, 46 and assures good electrical and mechanical contact between the wire strands and the walls of tongues 64, 45 which define the slots 66, 46, respectively. The transitions between the strands of wire in their original state and the restricted condition within the slots 66, 46 and between the restricted condition and the return to its original state as occur before and after the tongues 64, 45 act to restrict movement of conductors 18 with respect to tongues 64, 45. The strands of wire are trapped between the walls which define slots 66 and 46 and the coupling of the conductors 18 and the tongues 64 and 45 and do not depend upon the presence of insulation between the conductors 18 and the interior surface of the top wall of chamber 86.

Figure 2:
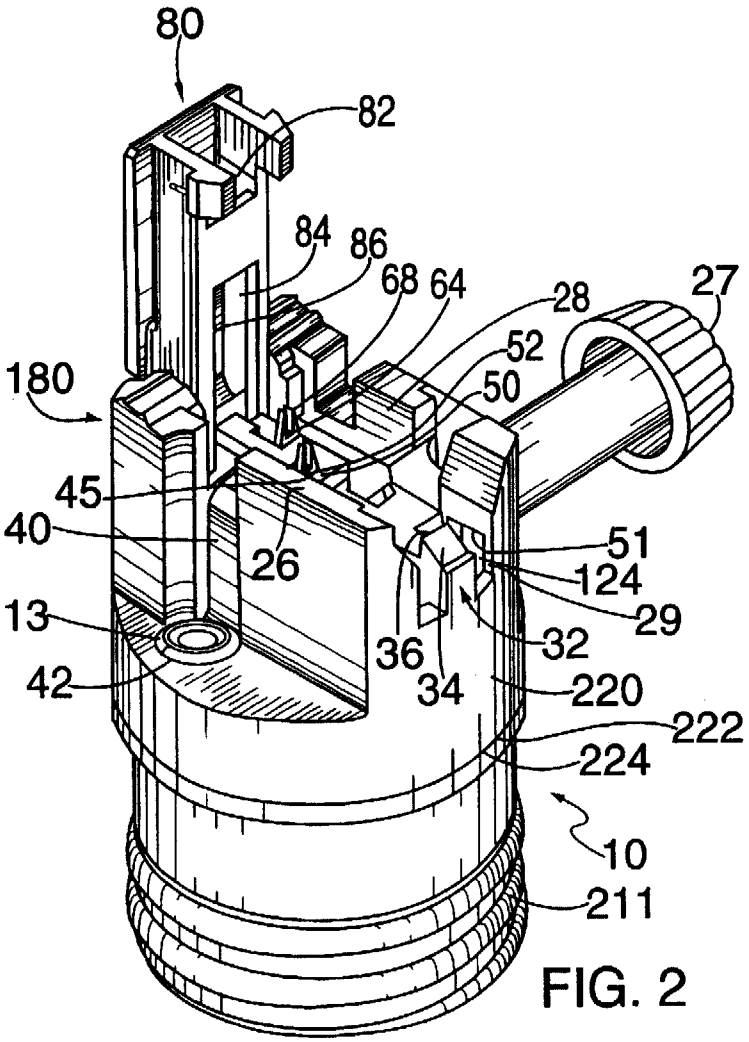
FIG. 2 is a top left perspective view of a socket according to the present invention with its actuator device in the open position.
Figure 21:
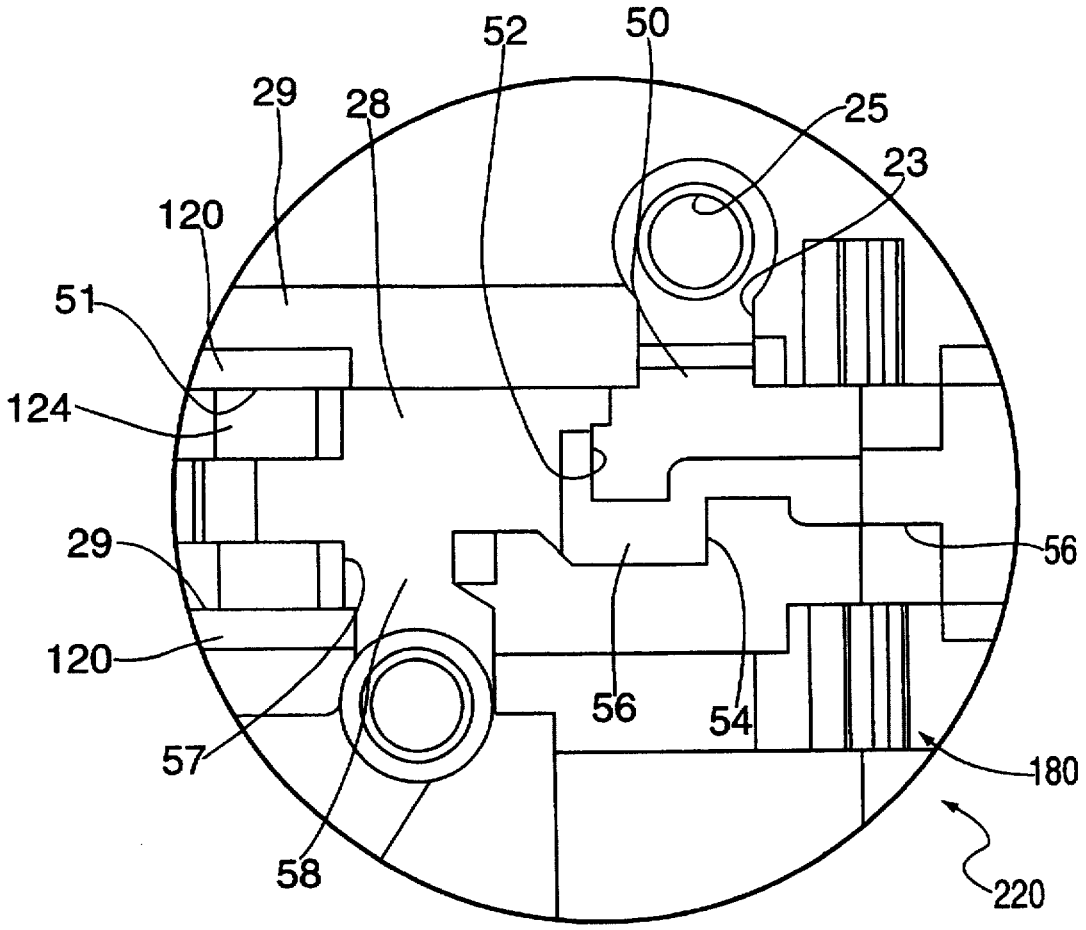
FIG. 21 is a top plan view of the socket molding of the device of FIG. 2.

As shown in FIGS. 2 and 21, the first insulation piercing and displacing contact 40 extends from mounting tab 42, which is anchored to body 220 by a rivet 13 extending through an aperture 43 in mounting tab 42 and an aperture 25 in body 220, along slot 23 in body 220 and over a portion of the floor 50 of recess 28 with the tongue 45 extending from behind a raised shoulder 52 which provides support to the tongue 45 to prevent flexing of the tongue 45 in a forward direction, to the right in FIG. 2. The second insulation piercing and displacing contact 60 is set on a portion of floor 50 of recess 28 with tongue 64 supported by raised shoulder 54 to prevent its forward deflection when made to engage a conductor 18. The tab adjacent end 70 extends into aperture 56 where it may be engaged by the movable member (not shown) which connects to the contact (not shown) within the screwshell 211. The movable member is moved between a first position where it contacts contact 60 and a second position where it does not contact contact 60 and thus provides the "on" and "off" positions for a bulb or lamp in screwshell 11. The movable member is controlled by the turning of a key 27 between two detent positions as is well known in the art. The body 62 of contact 60 extends under an overhang 56 and the tab adjacent end 72 locks against wall 57 of aperture 58 in floor 50 of recess 28, the edge 73 acting as a one-way clutch.

Figure 13:
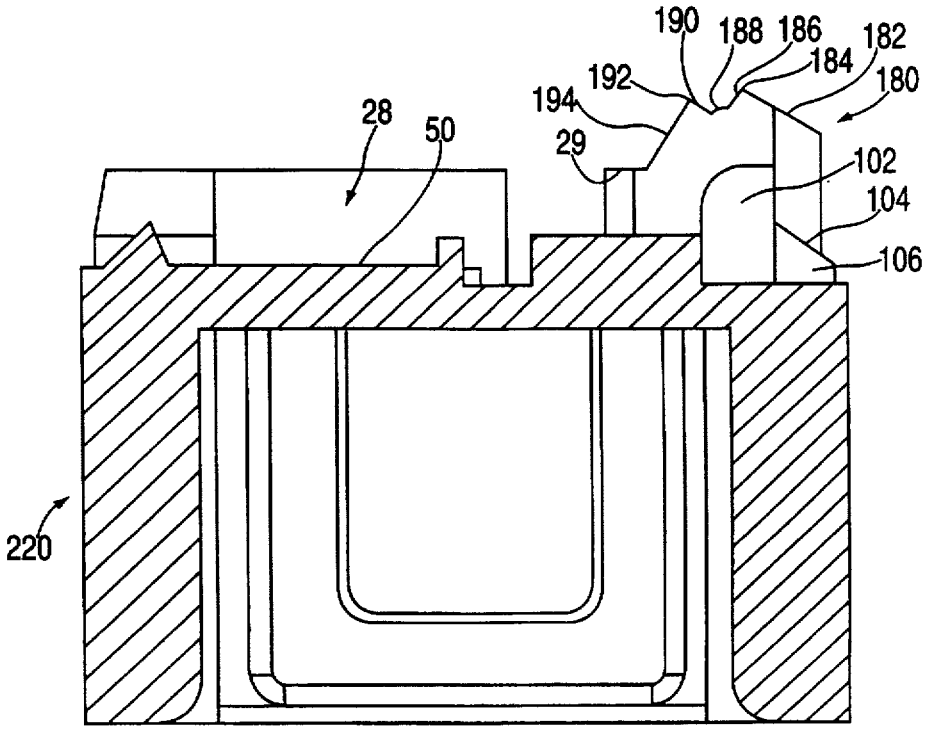
FIG. 13 is an enlarged view, in section and reversed, of the upper section of the socket of FIG. 11.

Turning now to FIGS. 9, 10, 18 and 20 the details of the actuating lever 80 can be better appreciated. The main body portion 88 of actuating lever 80 is generally rectangular with a rounded rear end 90 to prevent interference with the rotation of actuating lever 80 by body 220. The top wall 92 of body portion 88 extends laterally beyond the side walls 94 for a portion of its length. Bottom wall 96 in concert with side walls 94 and top wall 92 define the chamber 86 into which the electrical cord 17 will be placed using chamber entrance 82. The bottom wall 96 has a cut-out 98 adjacent to chamber entrance 82 to receive the cord 17 as it passes over the strain-relief tongue to be described below. A second cut-out 84 permits access of the tongues 64 and 45 into chamber 86 and cord 17. The actuating lever 80 pivots about pivot pins 100 which are positioned in slots 102 as shown in FIG. 13. The pivot pins 100 are pushed up the inclined surface 104 of block 106 and into slot 102. The flexibility and resilience of the pins 100 and the block 106 permits pins 100 to be moved into slot 102 despite their somewhat larger dimensions.

At the front end of side walls 94, adjacent cut-out 98 are two locking tabs 108 which extend below bottom wall 96. Slots 110 partially separate tabs 108 from side walls 94 and make tabs 108 more flexible. Each of the tabs 108 terminates in a locking rib 112 which has an inclined surface 114 which causes the tab 108 to deflect inwardly when it engages an aperture edge and a locking surface 116 which engages the underside of a surface. As the actuating lever 80 is rotated from the position shown in FIG. 2 to that shown in FIG. 18 the inclined surfaces 114 of tabs 108 engage complementarily inclined surfaces 120 of the side walls 29 of recess 28 (see FIG. 21). The tabs 108 are deflected towards the center of body 22 until locking ribs 112 are each adjacent a recess 124 in side walls 29 and floor 50. Then the tabs 108 are free to return to their initial positions putting locking surfaces 116 in contact with the underside 51 of the floor 50 of body 220 (see FIG. 18).

The overhanging portions 130 of top wall 92 of actuating lever 80 are shorter than the remainder of top wall 92 and are undercut as at 132 to provide two flexible indexing fingers 134. The rear surface of the indexing fingers 134 are inclined as at 136 and provide a sharp edge 138 at the lower end of inclined surface 136.

Figure 14:
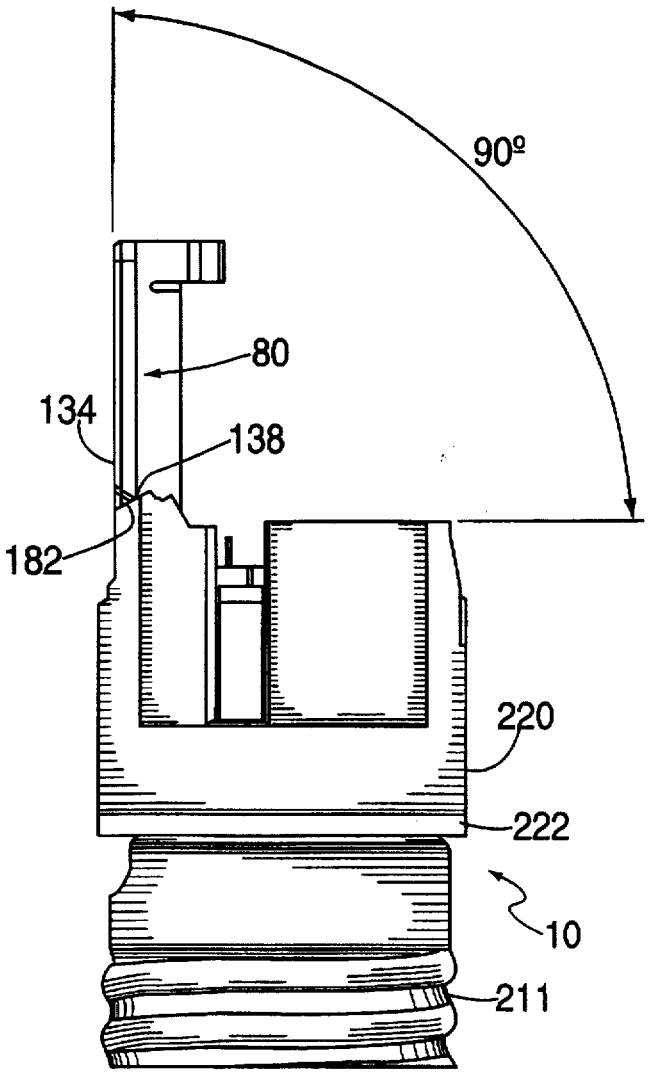
FIG. 14 is a side elevational view of the socket of FIG. 2 with the actuating device in its initial assembly position with respect to the socket insulating body.

Generally, when sockets 10 are bulk shipped in the condition shown in FIGS. 2 and 14 with the actuating lever 80 positioned as shown, the movement of the sockets 10 into one another can dislodge the actuating lever and it must be reinstalled to body 220 or it may be lost. The full length of the actuating lever 80 acts as a lever to dislodge pins 100 from slots 102. To prevent such unwanted disassembly, the instant invention makes use of a series of ratchet steps 180 on the walls 29 of recess 28 of body 220 which are engaged by the edges 138 of indexing fingers 134. One ratchet step holds the actuating lever 80 at a position which is at 45° with respect to the floor 50 of recess 28 (see FIGS. 15 and 16) where the socket 10 is ready for use and the actuating lever 80 cannot be separated from the body 220 and a second ratchet step where the actuating lever 80 is locked in its full closed position within recess 28 (see FIGS. 17 and 18). The combination of the indexing fingers 134 and the ratchet steps 180 prevent retrogression of the actuating lever 80 beyond certain limits established by the position and shape of the steps.

Figure 11:
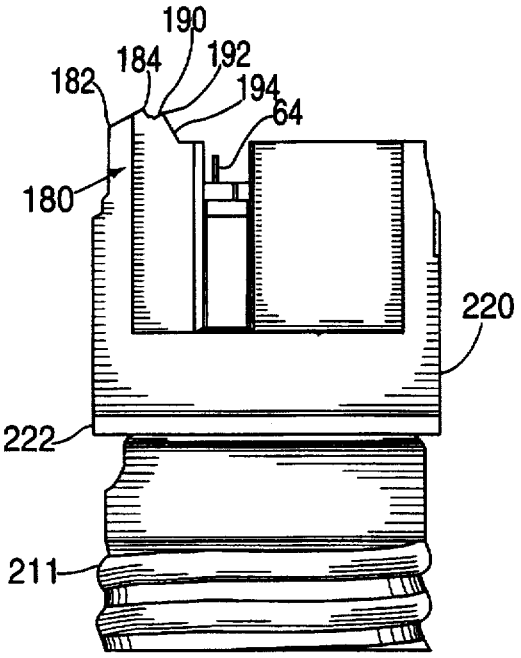
FIG. 11 is a side elevational view of the socket of FIG. 2 with the actuating device removed.
Figure 12:
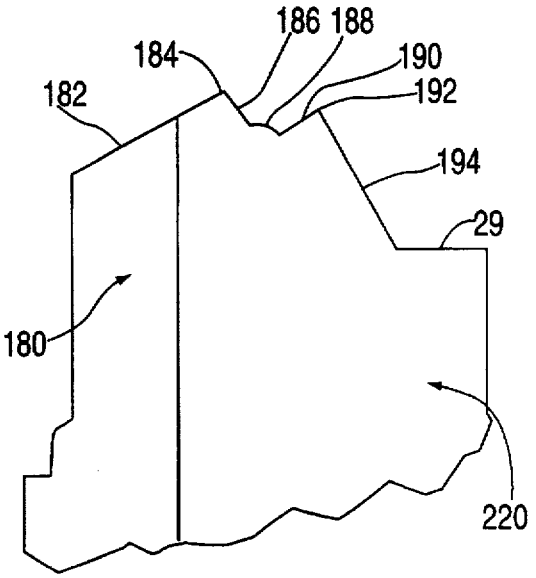
FIG. 12 is an enlarged, fragmentary portion of the upper left portion of the socket shown in FIG. 11.
Figure 15:
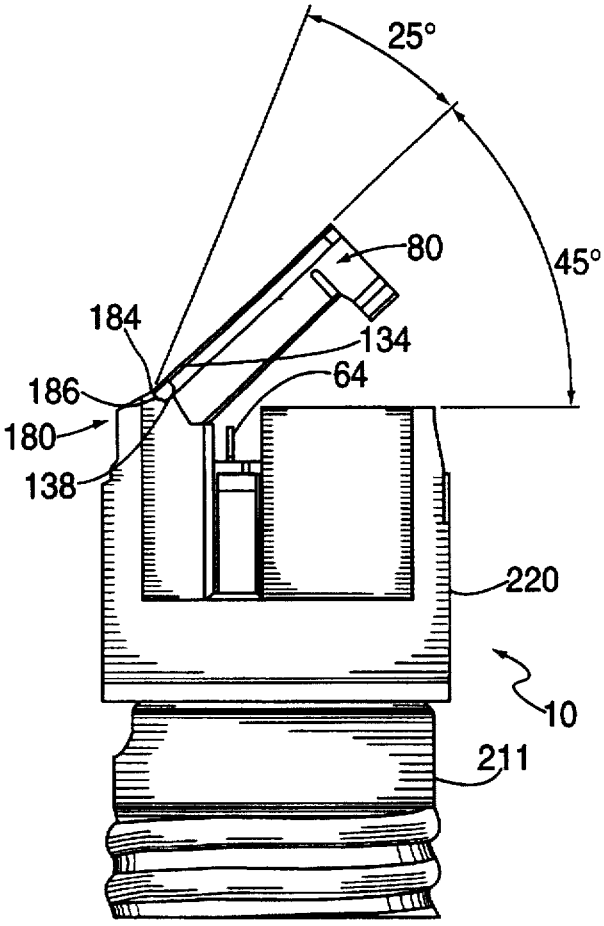
FIG. 15 is a side elevational view of the socket of FIG. 2 with the actuating device in its intermediate assembly position with respect to the socket insulating body.
Figure 16:
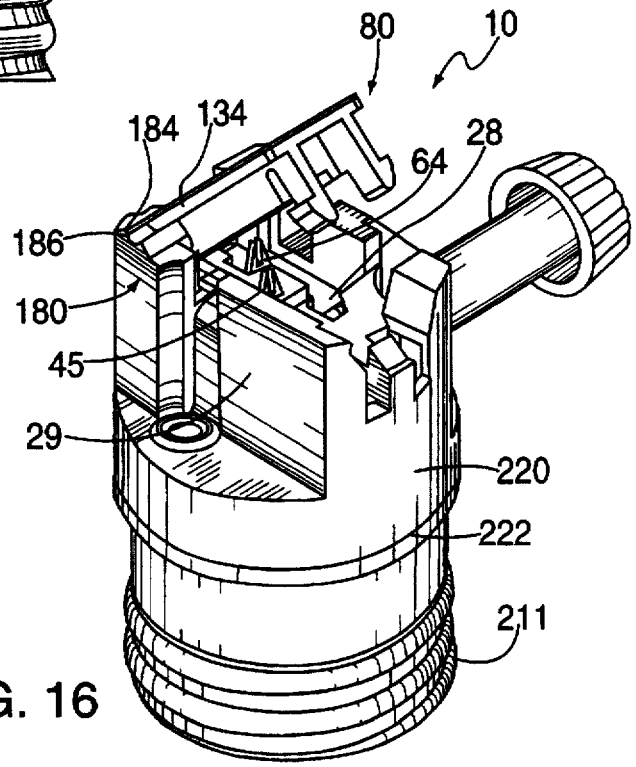
FIG. 16 is a top left perspective view of the socket as shown in FIG. 15.
Figure 18:
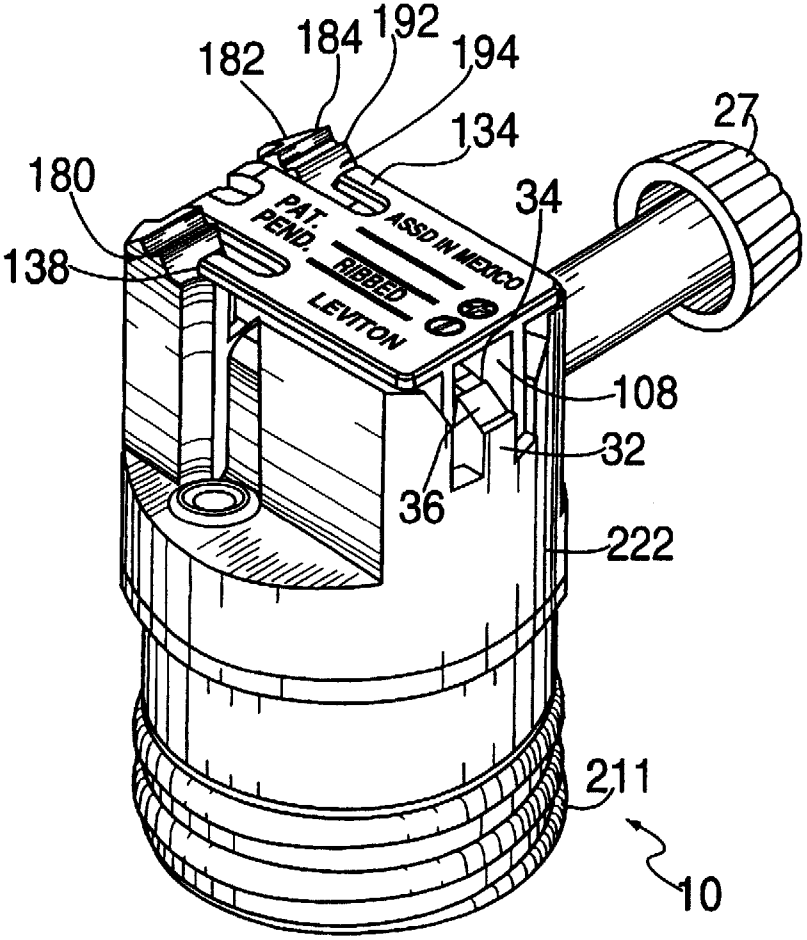
FIG. 18 is a top left perspective view of the socket as shown in FIG. 17.
Figure 17:
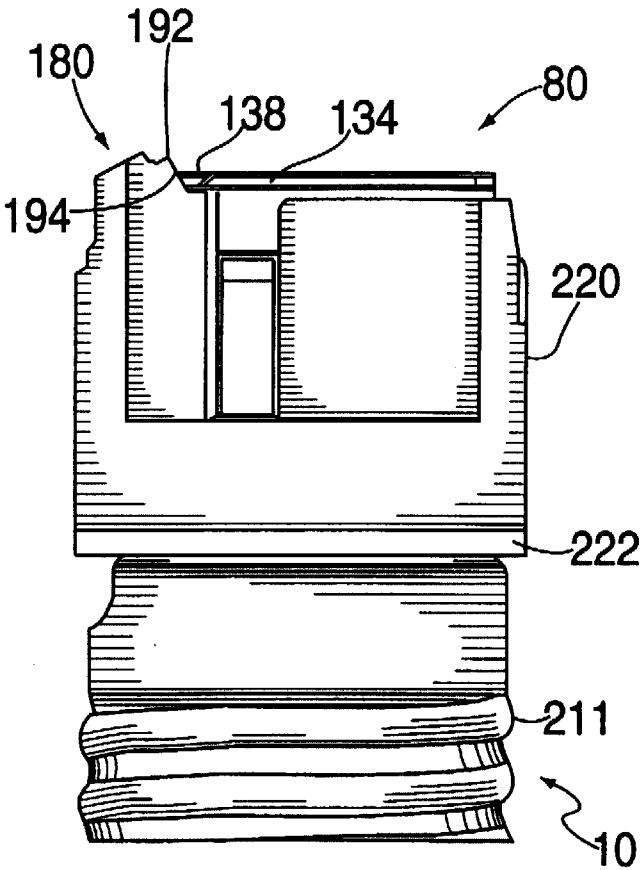
FIG. 17 is a side elevational view of the socket of FIG. 2 with the actuating device in its final assembly position with the socket insulating body.

Referring now to FIGS. 11 and 12, the ratchet steps 180 are more fully described. FIG. 12 is an enlarged, fragmentary portion of the side walls 29 of the recess 28 at the left, top portion of FIG. 11. Upwardly inclined surfaces 182 end in edges 184. When the actuating lever 80 is first installed to body 220, that is with pivot pins 100 in slots 102, the edges 138 of the indexing fingers 134 engage the leading inclined surfaces 182 as is shown in FIG. 14. In this initial assembly position, the actuating lever 80 can be moved in a retrograde movement away from recess 28 and may be easily separated from body 220 during handling or shipping. From edges 184, the surfaces 186 drop generally perpendicular to surfaces 182 followed by curved segments 188 which end in upwardly tapered surfaces 190. The edges 184 and the inclined surfaces 186 constitute the first locking steps and once the edges 138 of indexing fingers 134 go beyond edges 184 and contacts the surfaces 186 or 188, the actuating lever 80 can no longer be rotated away from recess 28 and separated from body 220. This condition is shown in FIGS. 15 and 16. The upwardly inclined surfaces 190 end in sharp, pointed edges 192 followed by downwardly inclined surfaces 194 ending at the top of wall 29. Once the edges 138 of the indexing fingers 134 have been moved over edges 192 and made to engage surfaces 194, as shown in FIGS. 17 and 18, very limited movement of the actuating lever 80 in a counterclockwise direction is possible until the two locking tabs 108 are placed in their locking position with locking surfaces 116 engaging the underside 51 of floor 50.

At the entrance to recess 28, at the opposite end from ratchet steps 180 is an upstanding member 32 which has an upwardly inclined top surface 34 which meets rear surface 38 along a sharp edge 36. The upstanding member 32 is positioned opposite cut-out 98 in the bottom wall 96 of actuating lever 80 as is shown in FIG. 18. The purpose of the upstanding member 32 is to provide strain-relief and prevent any forces applied to the electrical cord 17 to be applied to the electrical cord 17 at the contacts 40 and 60 and interfere with the juncture of the contacts 40 and 60 and electrical cord 17 as by removing the conductors 18 from the contacts 40, 60, pulling the cord 17 and contacts 40, 60 from socket 10, pulling the cord from socket 10, severing the conductors 18 or otherwise.

Figure 19:
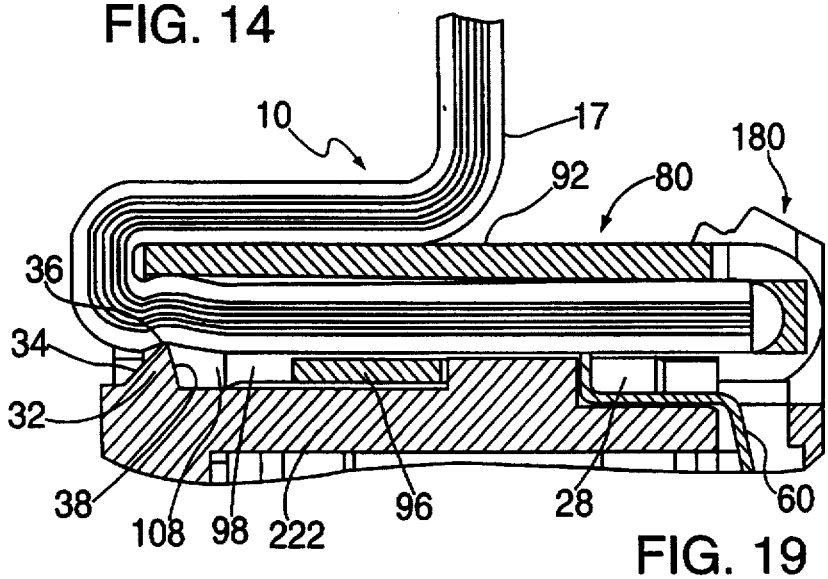
FIG. 19 is a fragmentary, side elevational view, in section, of the actuating of the socket of FIG. 2 closed upon an electrical cord.

The edge 36 engages the electrical cord 17 (see FIG. 19) and distorts it and pushes it against the underside of top wall 92. Forces applied to electrical cord 17 will be applied to this joint rather than the juncture between conductors 18 and contacts 40 and 60.

While there have been shown and described and pointed out the fundamental novel features of the invention as applied to the preferred embodiments, it will be understood that various omissions and substitutions and changes of the form and details of the device illustrated and in its operation may be made by those skilled in the art, without departing from the spirit of the invention.

We claim:

1. A lamp socket assembly comprising:

a) a substantially cylindrical screwshell having a substantially closed end, an open end and a wall in which is formed a screw thread between said ends, said screwshell making an electrical connection with the threaded metal base of an electrical lamp placed in said screwshell through said open end and made to threadably engage said screw thread of said screwshell wall;

b) a disk of insulating material having a first surface and a second surface;

c) a body member fabricated of insulating material having a first end surface and a second end surface parallel with one another and spaced apart along the longitudinal axis of said assembly; said disk positioned between said screwshell and said body member with said first surface of said disk adjacent said substantially closed end of said screwshell and said second surface of said disk adjacent said second end surface of said body member, d) a substantially U-shaped recess in said first end surface extending across said first end surface perpendicular to said longitudinal axis and into said body member towards said second end surface; said recess having a width less than said first end surface diameter to provide a shoulder on said first surface to each side of said recess, said recess having a floor and two vertical walls parallel with said longitudinal axis;

e) a first conductive member having a first end and a second end;

f) first fastening means holding in assembly said screwshell, said disk, said body member and said second end of said first conductive member;

g) said first conductive member having a first insulation displacing contact at said first end extending into said recess for displacing the insulation and making contact with the first central metallic conductor of an insulated electrical cord having two side-by-side linked insulated electrical conductors;

h) a second conductive member having a third end and a fourth end;

i) a displaceable tongue having a fifth end and a sixth end, said fifth end of said displaceable tongue passing through the non-closed portion of said substantially closed end of said screwshell and an aperture in said disk to engage said fourth end of said second conductive member, said sixth end of said displaceable tongue positioned in said screwshell to engage the contact button at the base of an electrical lamp threadably engaging said screw thread of said screwshell wall;

j) said second conductive member having a second insulation displacing contact at said third end extending into said recess for displacing the insulation and making contact with the second central metallic conductor of an insulated electrical cord having two side-by-side linked insulated electrical conductors;

k) actuator means having a first end and a second end, said actuator means pivotally mounted adjacent said second end to said vertical walls of said recess to permit said actuator means to move said first end of said actuator means towards and away from said floor of said recess;

l) said actuator means having a central passageway extending from adjacent said first end of said actuator means towards said second end of said actuator means to receive an electrical cord therein when said actuator means first end is pivoted away from said floor of said recess and to cause the engagement of the each of said two side-by-side linked insulated electrical conductors with its associated first and second insulation displacing contacts and the electrical connection of each of said first and second central metallic conductors with its associated first and second insulation displacing contacts;

m) lock means on said actuator means adjacent said first end to engage associated apertures in said vertical walls of said recess to retain said first end of said actuator means adjacent said floor of said recess;

n) said actuator means has a top member, a bottom member and two side members joined so as to form a hollow rectangular structure open adjacent said first end of said actuating means and closed adjacent said second end of said actuating means, the inner surfaces of said top member, said bottom member and said two side members defining said central passageway;

o) a first cut-out in said bottom member adjacent said first end of said actuator means;

p) an upstanding member extending upwardly from said recess floor towards said first end surface and parallel with said recess vertical walls at a point remote from the pivotal mounting of said actuating means to said vertical walls of said recess; and q) said upstanding member extending through said first cut-out to engage an electrical cord in said passageway to provide strain relief for the electrical cord.

2. A lamp socket assembly as defined in claim 1, wherein said upstanding member has a height above said floor of said recess such that its free end forces an electrical cord in said passageway against the inner surface of said top member and distorts said electrical cord.

3. A lamp socket assembly as defined in claim 1, wherein said upstanding member has a front face and a rear face and a top face inclined upwardly from said front face to said rear face to provide a line of engagement between said upstanding member and an electrical cord in said passageway.

4. A lamp socket assembly as defined in claim 2, wherein said upstanding member has a front face and a rear face and a top face inclined upwardly from said front face to said rear face to provide a line of engagement between said upstanding member and an electrical cord in said passageway.

5. A lamp socket assembly as defined in claim 1, wherein:

a) said first insulation piercing and displacing contact has a first end coupled to said first end of said first conductive member and a second end extending into said recess, said second end coming to a central point and a slot extending from the apex of the point towards said second end of said first insulation displacing contact;

b) said second insulation piercing and displacing contact has a third end coupled to said third end of said second conductive member and a fourth end extending into said recess, said fourth end coming to a central point and a slot extending from the apex of said point towards said third end of said second insulation piercing and displacing contact; and c) a second cut-out in said bottom member adjacent said second end of said actuating means whereby when said actuating means first end is moved towards the floor of said recess with an electrical cord in said central passageway said first and second insulation piercing and displacing contacts pass through said second cut-out and engage their associated ones of said two insulated electrical conductors of said electrical cord and to pierce and displace the insulation and make electrical and mechanical contact with the respective ones of said first and second central metallic conductors.

6. A lamp socket assembly as defined in claim 2, wherein:

a) said first insulation piercing and displacing contact has a first end coupled to said first end of said first conductive member and a second end extending into said recess, said second end coming to a central point and a slot extending from the apex of the point towards said second end of said first insulation piercing and displacing contact;

b) said second insulation piercing and displacing contact has a third end coupled to said third end of said second conductive member and a fourth end extending into said recess, said fourth end coming to a central point and a slot extending from the apex of said point towards said third end of said second insulation piercing and displacing contact; and c) a second cut-out in said bottom member adjacent said second end of said actuating means whereby when said actuating means first end is moved towards the floor of said recess with an electrical cord in said central passageway said first and second insulation piercing and displacing contacts pass through said second cut-out and engage their associated ones of said two insulated electrical conductors of said electrical cord and pierce and displace the insulation and make electrical and mechanical contact with the respective ones of said first and second central metallic conductors.

7. A lamp socket assembly as defined in claim 1, further comprising:

a) at least one indexing finger on said actuator means adjacent said second end; and b) a plurality of ratchet steps on at least one of said shoulders on said first surface to each side of said recess; and c) said at least one indexing finger engaging one of said plurality of ratchet steps on said at least one of said shoulders to limit movement of said first end of said actuator means towards and away from said floor of said recess.

8. A lamp socket assembly as defined in claim 1, further comprising:

a) at least one indexing finger on said actuator means adjacent said second end; and b) a plurality of ratchet steps on at least one of said shoulders on said first surface to each side of said recess; and c) said at least one indexing finger engaging one of said plurality of ratchet steps on said at least one of said shoulders to limit movement of said first end of said actuator means towards and away from said floor of said recess.

9. A lamp socket assembly as defined in claim 2, further comprising:

a) at least one indexing finger on said actuator means adjacent said second end;

b) a plurality of ratchet steps on at least one of said shoulders on said first surface to each side of said recess; and c) said at least one indexing finger engaging one of said plurality of ratchet steps on said at least one of said shoulders to limit movement of said first end of said actuator means towards and away from said floor of said recess.

10. A lamp socket assembly as defined in claim 1, further comprising:

a) at least one indexing finger on said actuator means adjacent said second end; and b) a plurality of ratchet steps on at least one of said shoulders on said first surface to each side of said recess; and c) said at least one indexing finger engaging one of said plurality of ratchet steps on said at least one of said shoulders to limit movement of said first end of said actuator means towards and away from said floor of said recess.

11. A lamp socket assembly as defined in claim 5, further comprising:

a) at least one indexing finger on said actuator means adjacent said second end; and b) a plurality of ratchet steps on at least one of said shoulders on said first surface to each side of said recess;

c) said at least one indexing finger engaging one of said plurality of ratchet steps on said at least one of said shoulders to limit movement of said first end of said actuator means towards and away from said floor of said recess.

12. A lamp socket assembly as defined in claim 1, wherein:

a) said top member is wider than said bottom member to provide top member extensions along each of said two side members from said first end of said actuating means towards said second end of said actuating means;

b) an indexing finger on the end of each of said two top member extensions adjacent said second end of said actuator means;

c) a plurality of ratchet steps on each of said two shoulders on said first surface to each side of said recess; and d) each of said two indexing fingers engaging a corresponding one of said plurality of ratchet steps on an associated one of said two shoulders to limit movement of said first end of said actuator means towards and away from said floor of said recess.

13. A lamp socket assembly as defined in claim 1, wherein:

a) said top member is wider than said bottom member to provide top member extensions along each of said two side members from said first end of said actuating means towards said second end of said actuating means;

b) an indexing finger on the end of each of said two top member extensions adjacent said second end of said actuating means; and c) a plurality of ratchet steps on each of said two shoulders on said first surface to each side of said recess;

d) each of said two indexing fingers engaging a corresponding one of said plurality of ratchet steps on an associated one of said two shoulders to limit movement of said first end of said actuator means towards and away from said floor of said recess.

14. A lamp socket assembly as defined in claim 5, wherein:

a) said top member is wider than said bottom member to provide top member extensions along each of said two side members from said first end of said actuating means;

b) an indexing finger on the end of each of said two top member extensions adjacent said second end of said actuating means; and c) a plurality of ratchet steps on each of said two shoulders on said first surface to each side of said recess;

d) each of said two indexing fingers engaging a corresponding one of said plurality of ratchet steps on an associated one of said two shoulders to limit movement of said first end of said actuator means towards and away from said floor of said recess.

15. A lamp socket assembly having:

a) an insulated body members said body member having a first end surface and a second end surface;

b) a substantially U-shaped recess in said first end surface extending across said first end surface perpendicular to a longitudinal axis of said lamp socket assembly and into said body member towards said second end surface said recess having a width less than said first end surface diameter to provide a shoulder on said first surface to each side of said recess;

c) said lamp socket assembly further having an actuator means pivotally coupled at a second end to said body member to move a first end of said actuator means towards and away from said body member;

d) a position control mechanism for fixing the position of said first end of said actuator means with respect to said body member comprising:

i) at least one indexing finger on said actuator means adjacent said second end; and ii) a plurality of ratchet steps on at least one of said shoulders of said body member adjacent said actuator means second end and to at least one side of said actuator means;

iii) said at least one indexing finger engaging one of said plurality of ratchet steps on said at least one of said shoulders to limit movement of said first end of said actuator means towards and away from said body member.

16. A lamp socket assembly as defined in claim 15 wherein:

a) said actuator means has two parallel side walls and an indexing finger on each of said side walls adjacent said second end of said actuator means; and b) a plurality of ratchet steps on the shoulders of said body member adjacent each of said side walls of said actuator means and said second end of said actuator means;

c) each of said two indexing fingers engaging a corresponding one of said plurality of ratchet steps on an associated one of said two pluralities of ratchet steps to limit movement of said first end of said actuator means towards and away from said body member.

* * * * *